US012673356B1

(12) United States Patent
Soles

(10) Patent No.: US 12,673,356 B1
(45) Date of Patent: Jul. 7, 2026

(54) SHEET MATERIAL CLAMP AND METHOD FOR DYNAMIC BINDING

(71) Applicant: Soles Enterprises, Inc, Brandon, SD (US)

(72) Inventor: Ben Soles, Brandon, SD (US)

(73) Assignee: Soles Enterprises, Inc, Brandon, SD (US)

( * ) Notice: Subject to any disclaimer, the term of this patent is extended or adjusted under 35 U.S.C. 154(b) by 9 days.

(21) Appl. No.: 19/012,553

(22) Filed: Jan. 7, 2025

(51) Int. Cl.
*B21D 39/03* (2006.01)

(52) U.S. Cl.
CPC ..... *B21D 39/031* (2013.01)

(58) Field of Classification Search
CPC ..... F16B 2/00; F16B 2/06; F16B 2/10; F16B 2/18; F16B 2/185; F16B 2/20; F16B 5/06; F16B 5/0607; F16B 5/0621; F16B 5/0635; F16B 5/0642; F16B 5/0692; B21D 39/02; B21D 39/021; B21D 39/031
See application file for complete search history.

(56) References Cited

U.S. PATENT DOCUMENTS 2,381,030 A * 8/1945 Blackburn ..... F16B 5/06 52/472
3,579,747 A 5/1971 Hawley
4,057,095 A * 11/1977 Hirota ..... F16B 2/248 160/395
4,170,810 A * 10/1979 Peleg ..... E04H 15/646 160/395
4,231,141 A * 11/1980 Derrick ..... E04H 15/646 24/565
4,267,876 A * 5/1981 Bloomfield ..... E04H 15/646 D25/119
4,662,038 A * 5/1987 Walker ..... F16B 5/0692 160/395
4,665,670 A * 5/1987 van den Burg ..... A01G 9/1415 160/354

(Continued)

FOREIGN PATENT DOCUMENTS

DE 202013101181 U1 * 3/2013 ..... F16B 2/10
DE 102013101756 A1 6/2014

(Continued)

*Primary Examiner* — Jonathan P Masinick
(74) *Attorney, Agent, or Firm* — Goodhue, Coleman & Owens, P.C.

(57) ABSTRACT

A clamp and method for dynamically binding overlapping sheet materials is disclosed. The clamp includes a female clamp member with opposing corners, a leg extending inwardly from one corner, and an arm extending outwardly. A male clamp member features opposing corners and a leg configured to interact with the female clamp member through an opening. The clamp dynamically generates pinching forces that increase proportionally with forces acting on the sheet materials. Assembly is achieved by mating the clamp members and engaging the corners to pinch the sheet materials, while disassembly is facilitated by torsional forces applied to the arm and male leg. A chamfered interior portion on the female leg allows smooth rotation during assembly and disassembly. The clamp is reusable, easy to assemble and disassemble, and compatible with thin materials such as plastics, fabrics, rubbers, metals, and composites.

13 Claims, 5 Drawing Sheets

(56) References Cited

U.S. PATENT DOCUMENTS

| | | | | |
|---|---|---|---|---|
| 4,682,642 | A * | 7/1987 | Hogshead, III | A01G 9/1415 160/395 |
| 5,009,540 | A * | 4/1991 | Nolan | F16B 5/0692 160/395 |
| 6,314,684 | B1 * | 11/2001 | Aviram | F16B 5/0692 52/11 |
| 8,091,312 | B2 | 1/2012 | Simpson et al. | |
| 10,948,002 | B2 * | 3/2021 | Haddock | F16B 2/065 |
| 11,352,793 | B2 * | 6/2022 | Haddock | E04D 13/10 |
| 11,919,282 | B2 * | 3/2024 | Dallan | B21D 47/04 |
| 2017/0184140 | A1 | 6/2017 | Giannatti et al. | |
| 2022/0240601 | A1 | 8/2022 | Axelsson | |

FOREIGN PATENT DOCUMENTS

| | | | | |
|---|---|---|---|---|
| DE | 102017128371 | A1 * | 6/2019 | F16B 2/10 |
| EP | 0628733 | A1 | 12/1994 | |
| EP | 2110564 | A1 | 10/2009 | |
| FR | 2980499 | A1 * | 3/2013 | B21D 39/025 |
| FR | 3064703 | A1 * | 10/2018 | F16B 2/22 |
| GB | 2366593 | A * | 3/2002 | F16B 2/10 |
| HU | 0800153 | A2 | 10/2009 | |
| TW | 201637784 | A | 11/2016 | |
| WO | 2020021178 | A1 | 1/2020 | |

* cited by examiner

SHEET MATERIAL CLAMP AND METHOD FOR DYNAMIC BINDING

FIELD OF THE INVENTION

The present invention relates generally to devices and methods for joining sheet materials. More specifically, it pertains to clamps that dynamically increase clamping forces in response to applied stresses while enabling easy assembly and disassembly without damaging the materials.

BACKGROUND

Methods for joining seams of sheet materials, such as stitching, heat welding, adhesives, and other binding approaches, are well known. While these methods are widely used, they often suffer from significant limitations. Seam failures frequently occur due to the combined effects of material weaknesses, suboptimal joining methods, and exposure to ongoing or dynamic stresses. Furthermore, many traditional sheet material joining methods are irreversible, difficult to disassemble, or cause damage to the materials when the seam is broken. Even when reversible, these methods tend to be time-consuming and cumbersome to undo.

Another critical drawback is that the binding force provided by these methods is typically static—once the seam is joined, the binding force remains constant regardless of the forces applied to the materials. This limitation reduces the reliability of the seam under increasing external stresses.

Accordingly, there is a need for a sheet material binding device and method that overcomes these limitations. Specifically, there is a need for a device that is easy to apply, disassemble without damaging the materials, and capable of providing a dynamic binding force that increases in response to external stresses applied to the seam.

SUMMARY

Therefore, it is a primary object, feature, or advantage of the present disclosure to improve over the state of the art.

It is a further object, feature, or advantage of the present disclosure to provide a sheet material clamp that dynamically increases its binding force in response to external forces applied to the seam.

It is a still further object, feature, or advantage of the present disclosure to enable quick and easy assembly and disassembly of the clamp without damaging the materials being joined.

Another object, feature, or advantage is to provide a reusable clamping device suitable for use with a variety of sheet materials, including plastics, fabrics, rubber, metal, and composites.

Yet another object, feature, or advantage is to provide a clamping device that maintains secure binding of sheet materials under variable stresses without requiring adhesives or stitching between joined sheet materials.

Still another object, feature, or advantage is to provide a clamping device that maintains secure binding of sheet materials under variable stresses without permanent deformation of the joined sheet materials.

It is also an object, feature, or advantage of the present disclosure to offer a lightweight, compact, and cost-effective solution for joining sheet materials.

A further object, feature, or advantage is to allow for easy customization of the clamp dimensions to accommodate various material thicknesses, seam lengths, and seam configurations.

An additional object, feature, or advantage is to provide a method for dynamically joining sheet materials that reduces the likelihood of seam failure under applied forces.

In at least one aspect, the invention provides a clamp for dynamically binding overlapping sheet materials. The clamp comprises a female clamp member with opposing female corners, a leg, and an arm, and a male clamp member with opposing male corners and a leg. The configuration of the clamp ensures that forces applied to the overlapping sheet materials generate pinching forces between the female and male clamp members, wherein the pinching forces increase proportionally in response to the applied forces.

In at least one other aspect, the invention provides a clamp for dynamically binding overlapping sheet materials, including a female clamp member and a male clamp member, each having opposing corners. The clamp features a first mated pair of corners and a second mated pair of corners that cooperate to pinch the overlapping sheet materials. The forces applied to the overlapping sheet materials generate pinching forces between the first and second mated pairs of corners, with the pinching forces increasing proportionally as external forces increase.

In still another aspect, the invention also provides a method for dynamically binding overlapping sheet materials using the clamp. The method includes providing a female clamp member and a male clamp member, placing overlapping sheet materials atop the male clamp member, and mating the female and male clamp members to pinch the overlapping sheet materials. The method further includes dynamically increasing pinching forces between the clamp members in response to external forces applied to the overlapping sheet materials, and disassembling the clamp to release the sheet materials.

One or more of these and/or other objects, features, or advantages of the present disclosure will become apparent from the specification and claims that follow. No single aspect need provide each and every object, feature, or advantage. Different aspects may have different objects, features, or advantages. Therefore, the present disclosure is not to be limited to or by any objects, features, or advantages stated herein.

BRIEF DESCRIPTION OF THE DRAWINGS

Illustrated aspects of the disclosure are described in detail below with reference to the attached drawing figures, which are incorporated by reference herein.

DETAILED DESCRIPTION

FIGS. 1-7 provide various pictorial illustrations for exemplary aspects of a sheet material clamp 10 and method for dynamically binding in accordance with the objects, features, and advantages of the present disclosure.

Clamp 10 relates to a device for dynamically binding overlapping sheet materials 28, 30. Clamp 10 generates pinching forces that increase proportionally with external forces applied to overlapping sheet materials 28, 30, ensuring a secure and reliable connection under varying or increasing loads. Additionally, clamp 10 is designed for easy assembly and disassembly without damaging sheet materials 28, 30, making clamp 10 reusable and adaptable to diverse applications. Clamp 10 accommodates a variety of thin sheet materials, including plastics, fabrics, rubbers, metals, and composites. Clamp members 12, 20 can be manufactured from materials such as plastics (e.g., polycarbonate, polypropylene) for lightweight and cost-effective applications, metals (e.g., aluminum, stainless steel, or titanium) for heavy-duty uses requiring greater strength, or composites to balance weight and strength.

Figure 1:
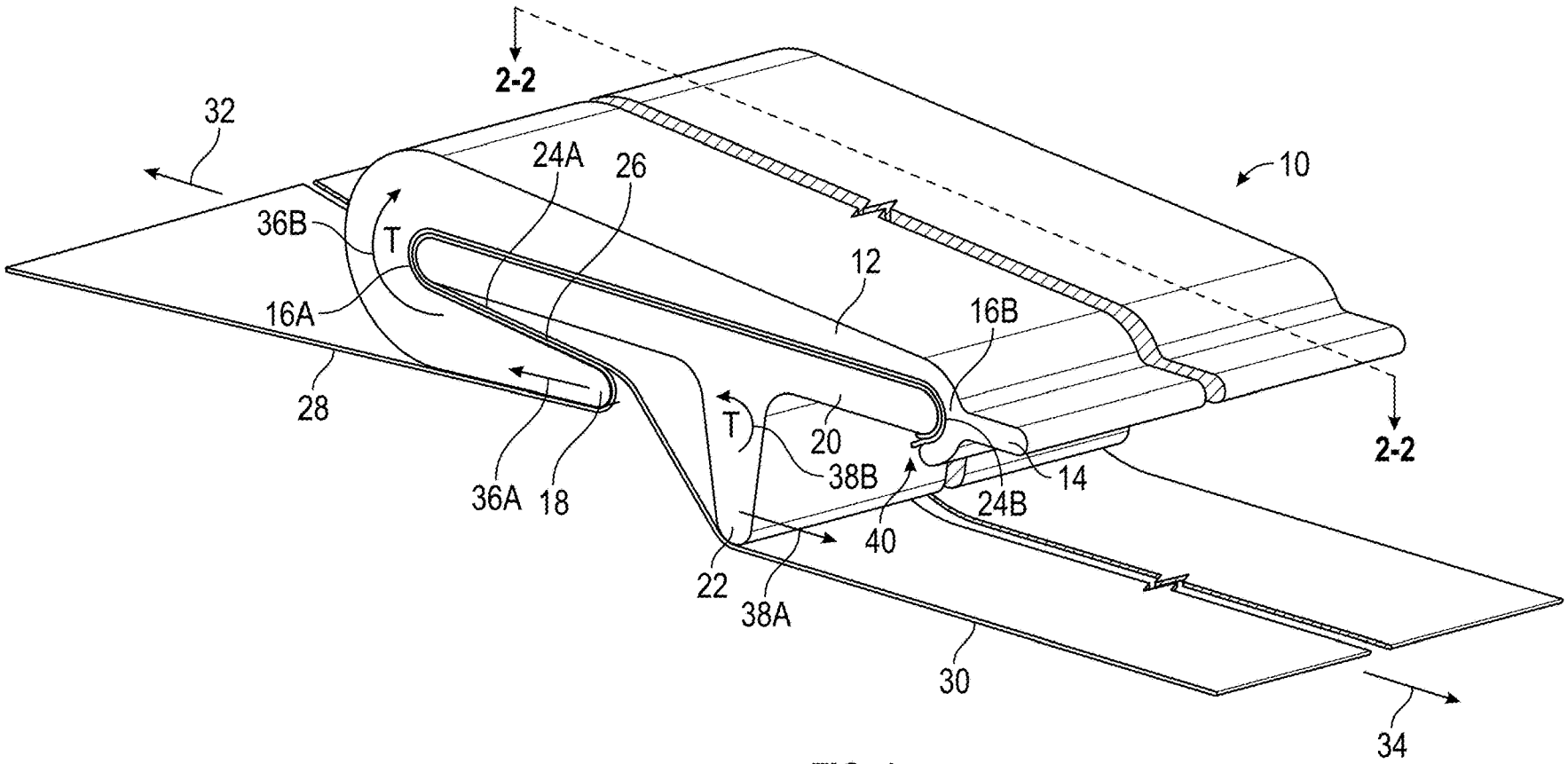
FIG. 1 is a perspective view of the clamp in accordance with an exemplary aspect of the present invention.
Figure 2:
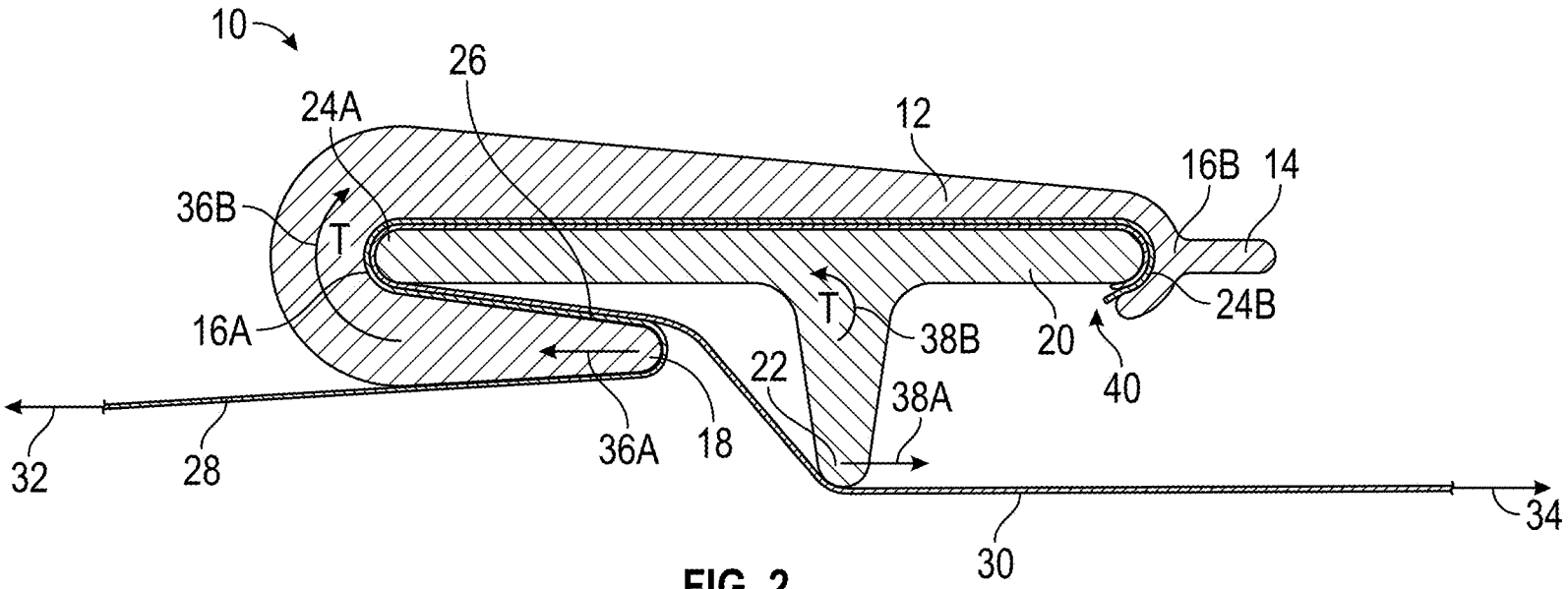
FIG. 2 is a cross-sectional view taken along line 2-2 in FIG. 1, showing the relationship between the female and male clamp members and overlapping sheet materials.
Figure 3:
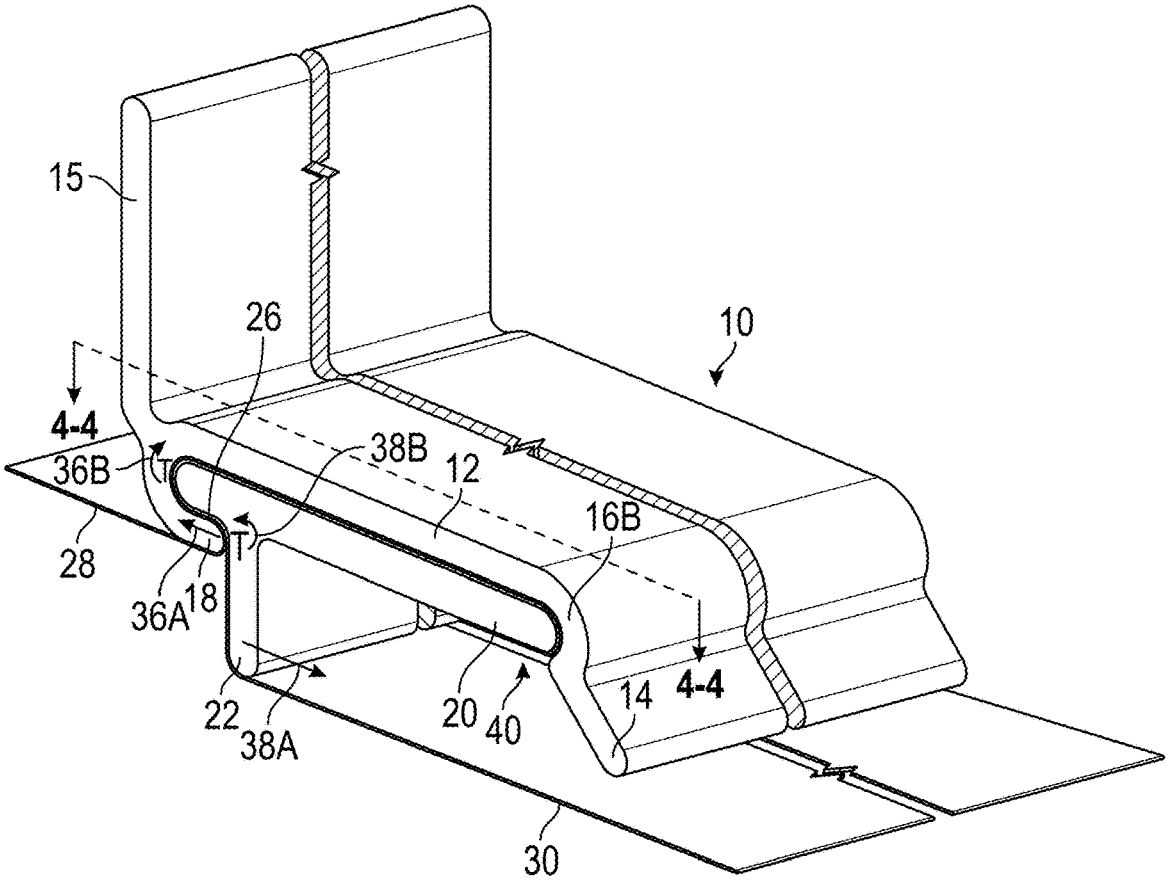
FIG. 3 is a perspective view of the clamp in accordance with another exemplary aspect of the present invention.
Figure 4:
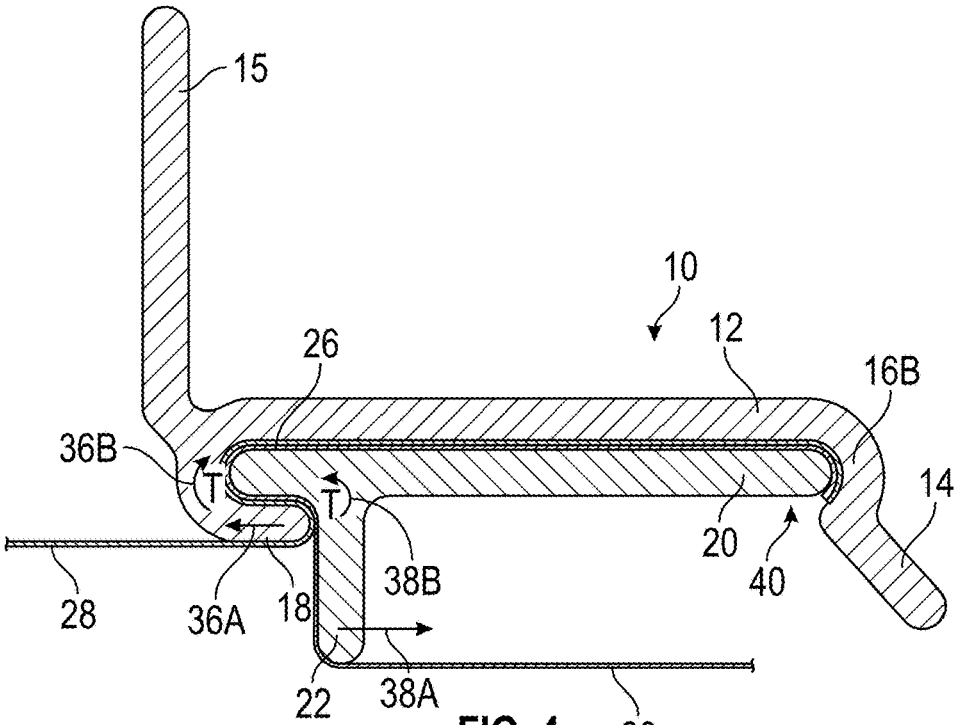
FIG. 4 is a cross-sectional view taken along line 4-4 in FIG. 3, showing the relationship between the female and male clamp members and overlapping sheet materials.
Figure 5:
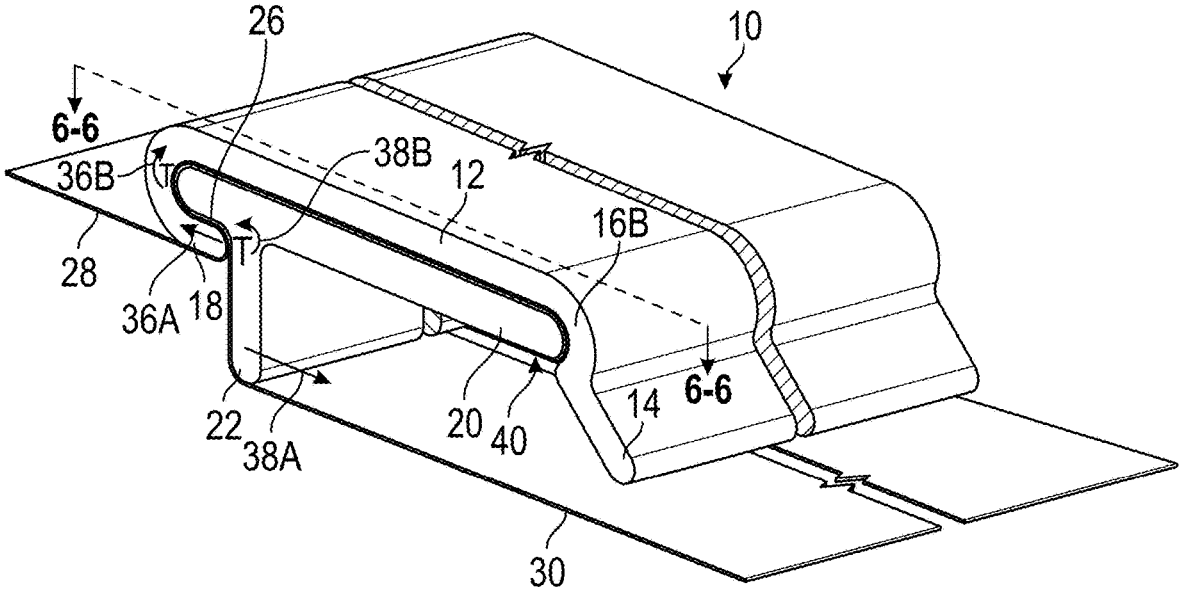
FIG. 5 is a perspective view of the clamp in accordance with another exemplary aspect of the present invention.
Figure 6:
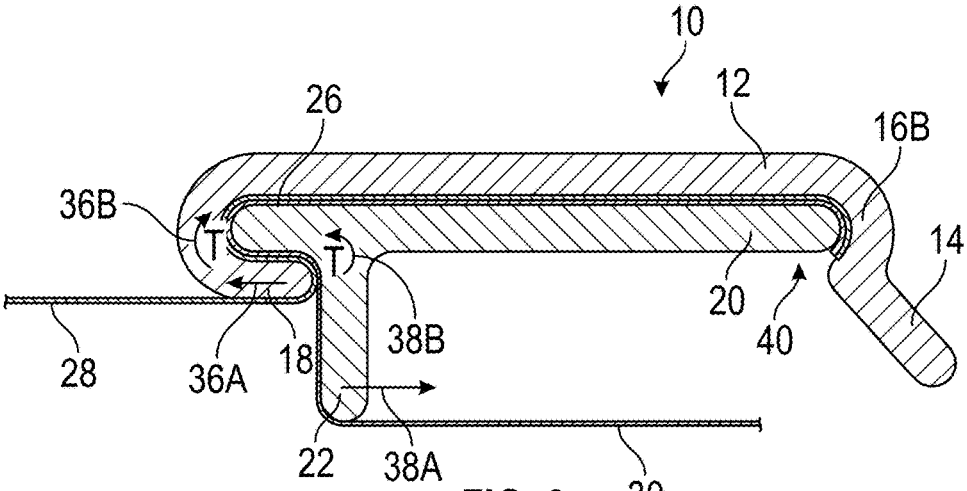
FIG. 6 is a cross-sectional view taken along line 6-6 in FIG. 5, showing the relationship between the female and male clamp members and overlapping sheet materials.
Figure 7:
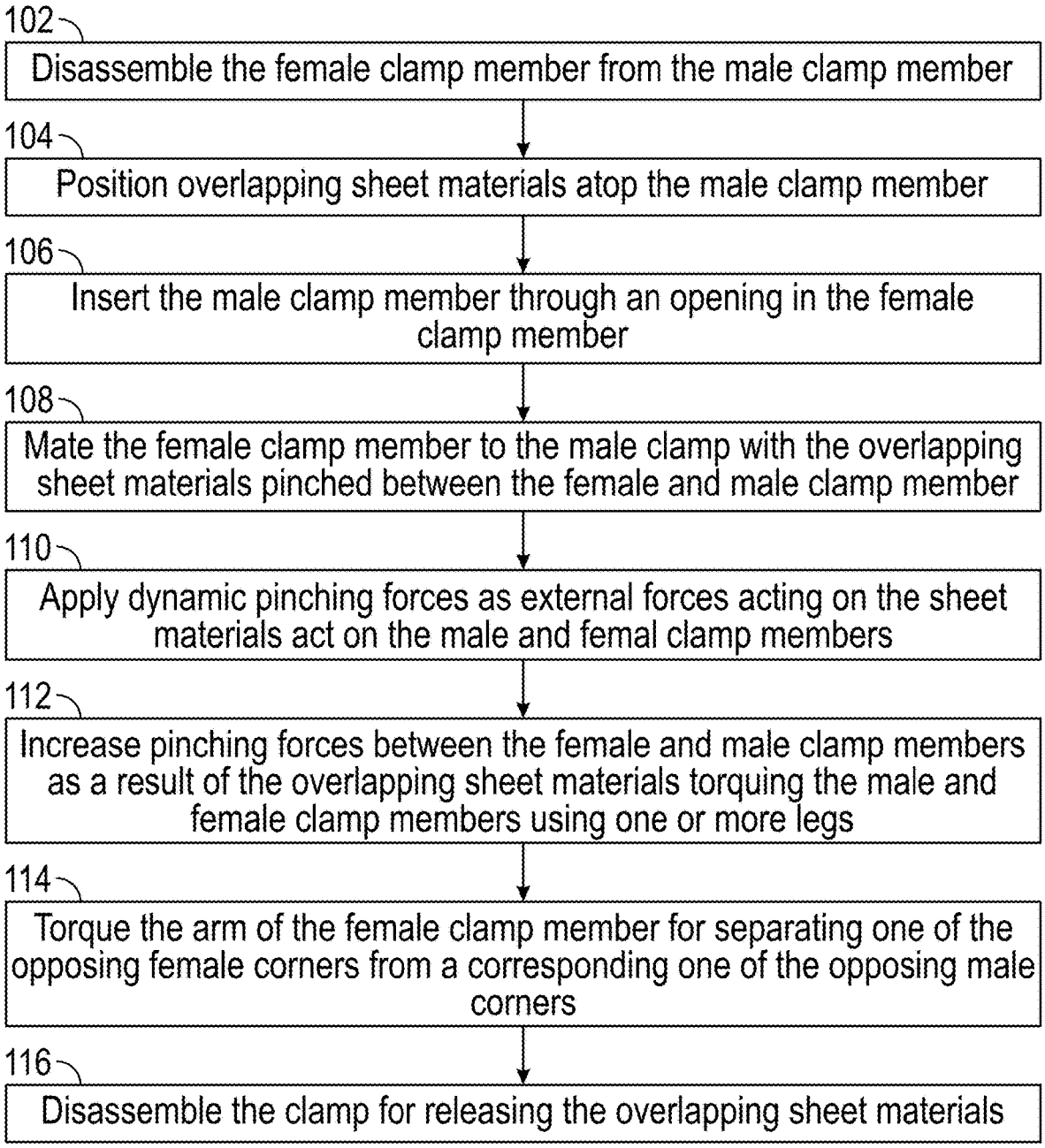
FIG. 7 is a flowchart illustrating the steps for assembling, dynamically clamping, and disassembling overlapping sheet materials using the clamp.

Clamp 10 includes female clamp member 12 and male clamp member 20, which cooperate to securely pinch and hold portions of overlapping sheet materials 28, 30 between them. Female clamp member 12 includes female corners 16A, 16B that mate with male corners 24A, 24B of male clamp member 20 to form first and second mated pairs of corners. Extending inwardly from female corner 16A is leg 18, which interacts with the forces carried by overlapping sheet material 28, and extending outwardly from male clamp member 20 is leg 22, which interacts with the forces carried by overlapping sheet material 30; both serve as part of the clamping interface. Leg 18 includes chamfered interior portion 26, which allows male corner 24A to be rotated relative to female corner 16A such that male corner 24B can be separated from female corner 16B during disassembly of clamp 10. Similarly, chamfered interior portion 26 allows male corner 24A to be inserted into and rotated relative to female corner 16A such that male corner 24B can be joined to female corner 16B during assembly of clamp 10. Extending outwardly from female corner 16B is arm 14, which provides a torque application point for bending/rotating female clamp member 12 during assembly and disassembly. An additional arm 15 on female clamp member 12 may be positioned on the opposite side of female clamp member 12, such as shown in FIGS. 3-4. Arms 14, 15, shown in FIGS. 1-6, can be shaped and angled to enhance torque application, providing balanced or additional leverage for assembly and disassembly. Male clamp member 20 includes male corners 24A, 24B and outwardly extending leg 22, which interacts with the forces carried by overlapping sheet material 30 and passes through opening 40 in female clamp member 12 to ensure alignment of clamp members 12, 20 during assembly.

Clamp 10 may include surface irregularities on adjoining surfaces of male clamp member 20 and female clamp member 12 to enhance friction and improve pinching of overlapping sheet materials 28, 30. These tactile features can include raised ridges, textured surfaces, dimples, or grooves on some or all mating surfaces, including on female corners 16A, 16B and male corners 24A, 24B. Tactile features may also be incorporated onto arms 14, 15 of female clamp member 12 to facilitate user handling and torque application. For example, arms 14, 15 may include knurled surfaces, rubberized coatings, or patterned grips to improve the user's ability to apply rotational forces during assembly or disassembly. Similar gripping features can also be included on leg 18 of female clamp member 12 and leg 22 of male clamp member 20 to enhance grip of overlapping sheet materials 28, 30. Surface irregularities include the use of non-slip coatings, such as elastomeric or rubberized layers, which can be applied to mating surfaces of corners 16A, 24A and 16B, 24B, arms 14, 15, or legs 18, 22 to improve friction and handling. In some embodiments, magnetized surfaces may be used for applications involving metallic sheet materials 28, 30, while micro-textured coatings may be applied for improved interaction with specific fabrics or composites.

In step 102, female clamp member 12 is disassembled from male clamp member 20 by applying opposing torsional forces to arm 14 in the case of clamp 10 shown in FIGS. 1-2 and 5-6 and arms 14, 15 in the case of clamp 10 shown in FIGS. 3-4 of female clamp member 12 and optionally leg 22 of male clamp member 20. This action disengages the mated corners 16A, 24A and 16B, 24B, allowing male clamp member 20 to be withdrawn through opening 40 of female clamp member 12. In step 104, overlapping sheet materials 28, 30 are positioned atop male clamp member 20, with the end portions to be clamped aligned with mated corners 16B, 24B. The overlapping sheet materials 28, 30 extend outwardly from clamp 10 in opposing directions, where they act as carriers of external forces 32, 34 during operation.

In step 106, male clamp member 20 is inserted through opening 40 in female clamp member 12, aligning mated corners 16A, 24A. Leg 22 of male clamp member 20 passes completely through opening 40, ensuring proper alignment for subsequent mating. In step 108, female clamp member 12 is mated to male clamp member 20 by rotating female clamp member 12. This rotation engages the first mated pair of corners 16A, 24A to partially pinch overlapping sheet materials 28, 30, followed by engaging the second mated pair of corners 16B, 24B to securely clamp the sheet materials between the female and male clamp members 12, 20.

As forces 32, 34 act on overlapping sheet materials 28, 30 in step 110, they generate linear forces 36A, 38A and torsional forces 36B, 38B. Forces acting on leg 18 of female clamp member 12 and leg 22 of male clamp member 20, dynamically increasing the pinching forces at mated corners 16A, 24A and 16B, 24B by increasing the opposing torque and opposing linear forces acting on female and male clamp members 12, 20. In step 112, the pinching forces between female clamp member 12 and male clamp member 20 increase dynamically in response to the growing forces 32, 34, ensuring a secure grip of the overlapping sheet materials 28, 30 under varying or increasing loads.

In step 114, torque is applied to arm 14 and/or arm 15 (see FIGS. 3-4) of female clamp member 12 to separate mated corners 16B, 24B. This initial disengagement reduces the pinching forces and prepares clamp 10 for full disassembly. In step 116, clamp 10 is fully disassembled by continuing to rotate female clamp member 12 relative to male clamp member 20, disengaging mated corners 16A, 24A whereby both mated pairs of corners 16A, 24A and 16B, 24B are disengaged and clamp 10 is disassembled. Once disassembled, overlapping sheet materials 28, 30 can be removed from clamp 10 without damage.

The configuration of clamp 10 allows opposing portions of overlapping sheet materials 28, 30 to extend in opposite directions outside clamp 10. These extended portions of overlapping sheet materials 28, 30 act as carriers of forces 32, 34 resulting from external forces acting on overlapping sheet materials 28, 30 and from the weight of the overlapping sheet materials 28, 30, transferring those forces into leg 18 of female clamp member 12 and leg 22 of male clamp member 20. Forces 32, 34 carried into legs 18, 22 generate both linear forces 36A, 38A and torsional forces 36B, 38B, which drive the dynamic clamping action. Arms 14, 15 of female clamp member 12 are strategically positioned to provide additional leverage points to counteract forces 32, 34 during assembly and disassembly of clamp 10.

The disclosure is not to be limited to the particular aspects described herein. In particular, the disclosure contemplates numerous variations in a sheet material clamp 10 and method for dynamically binding. The foregoing description has been presented for purposes of illustration and description. It is not intended to be an exhaustive list or limit any of the disclosure to the precise forms disclosed. It is contemplated that other alternatives or exemplary aspects are considered included in the disclosure. The description is merely examples of aspects, processes or methods of the disclosure. It is understood that any other modifications, substitutions, and/or additions can be made, which are within the intended spirit and scope of the disclosure.

What is claimed is:

1. A clamp for dynamically binding overlapping sheet materials, comprising:

a female clamp member having opposing female corners, a leg, and an arm;

a male clamp member having opposing male corners and a leg;

wherein forces applied to the overlapping sheet materials generate pinching forces between the female and male clamp members by operation of opposing torsional forces generated from the legs of the male and female clamps, the pinching forces increasing in proportional response to the applied forces.

2. The clamp of claim 1, further comprising:

a chamfered interior portion of the leg of the female clamp configured to facilitate rotation of the female clamp member relative to the male clamp member during assembly or disassembly.

3. The clamp of claim 1, wherein the female clamp member and the male clamp member can be separated by applying opposing torsional forces to the arm of the female clamp member and the leg of the male clamp member.

4. The clamp of claim 1, further comprising:

an opening of the female clamp member between one of the opposing female corners and the leg of the female clamp member, wherein the male clamp member is inserted into and removed from the female clamp member through the opening of the female clamp member.

5. The clamp of claim 1, wherein the leg of the male clamp member extends through an opening of the female clamp member.

6. The clamp of claim 1, wherein the leg of the female clamp member extends inwardly from one of the opposing female corners.

7. The clamp of claim 1, wherein the arm of the female clamp member extends outwardly from one of the opposing female corners.

8. A clamp for dynamically binding overlapping sheet materials, comprising:

a female clamp member having opposing female corners, a leg, and an arm;

a male clamp member having opposing male corners and a leg;

a first mated pair of corners comprising one of the opposing male and female corners;

a second mated pair of corners comprising the other opposing male and female corners;

wherein the overlapping sheet materials free terminal end portions positioned within the mated pairs of corners and opposing forces applied to the overlapping sheet materials generate pinching forces between the first and second mated pair of corners for securing the free terminal end portions of the overlapping sheet materials.

9. The clamp of claim 8, wherein the pinching forces increase in proportional response to the applied forces acting on the overlapping sheet materials.

10. The clamp of claim 8, wherein the pinching forces increase as a result of the legs of the female and male clamp members in proportional response to the applied forces acting on the overlapping sheet materials.

11. The clamp of claim 8, wherein the leg of the male clamp member extends through an opening in the female clamp member.

12. The clamp of claim 8, wherein the leg of the female clamp member is chamfered to facilitate rotation of the female clamp member relative to the male clamp member during assembly or disassembly.

13. The clamp of claim 8, further comprising:

an opening of the female clamp member between the first and second pair of mated corners, wherein the male clamp member is inserted into and removed from the female clamp member through the opening of the female clamp member.

* * * * *